US005797230A

United States Patent [19]

Lassen

[11] Patent Number: 5,797,230

[45] Date of Patent: Aug. 25, 1998

[54] ELEMENT FOR USE IN MAKING A REINFORCED CONCRETE STRUCTURE WITH CAVITIES, FILLER BODY FOR MAKING SUCH AN ELEMENT, AND METHOD OF MAKING A REINFORCED CONCRETE STRUCTURE WITH CAVITIES

[76] Inventor: Jørgen Lassen, Lundely 9, DK-2900 Hellerup, Denmark

[21] Appl. No.: 714,043

[22] PCT Filed: Mar. 10, 1994

[86] PCT No.: PCT/DK94/00104

§ 371 Date: Sep. 6, 1996

§ 102(e) Date: Sep. 6, 1996

[87] PCT Pub. No.: WO95/24532

PCT Pub. Date: Sep. 14, 1995

[51] Int. Cl.[6] ..... E04B 5/36

[52] U.S. Cl. ..... 52/323; 52/320; 52/380; 52/576; 52/742.14; 52/745.13; 52/745.2

[58] Field of Search ..... 52/320, 323, 380, 52/576, 742.14, 745.13, 745.2

[56] References Cited

U.S. PATENT DOCUMENTS

| | | | |
|---|---|---|---|
| 1,140,571 | 5/1915 | Burchartz | 52/323 |
| 1,767,067 | 6/1930 | Goldsmith | 52/323 |
| 3,213,581 | 10/1965 | Macchi . | |
| 3,624,978 | 12/1971 | Skinner | 52/380 X |
| 3,640,040 | 2/1972 | MacLean, III. et al. . | |
| 4,116,415 | 9/1978 | Ward | 52/576 X |
| 4,495,744 | 1/1985 | Carl | 52/576 |

FOREIGN PATENT DOCUMENTS

| | | | |
|---|---|---|---|
| 2633526 A1 | 2/1978 | Germany . | |
| 4121113 A1 | 1/1992 | Germany . | |
| 1141691 | 1/1969 | United Kingdom | 52/323 |
| WO92/06253 | 4/1992 | WIPO . | |

*Primary Examiner*—Christopher Kent
*Attorney, Agent, or Firm*—Larson & Taylor

[57] ABSTRACT

An element for use in making a reinforced concrete structure of substantially planar shape. The element includes a) at least a lower reinforcing mesh consisting of mutually crossing reinforcing rods (1, 2) rigidly secured to each other, and b) a number of spaced filler bodies (3) of substantially identical shape and size cooperating with the lower mesh (1, 2) so as to locate them in a regular pattern corresponding to the pattern of the lower mesh. These filler bodies (3) interengage (14) with the lower mesh (1, 2) so as to form a rigid body, with the spaced filler bodies cooperating with the reinforcing mesh to provide cavities in the finished structure. The filler bodies (3) include flanges (8) cooperating with each other to form a lower shuttering. Preferably also, an upper reinforcing mesh (1*a*, 2*a*) is used, further increasing the rigidity of the element.

24 Claims, 5 Drawing Sheets

ELEMENT FOR USE IN MAKING A REINFORCED CONCRETE STRUCTURE WITH CAVITIES, FILLER BODY FOR MAKING SUCH AN ELEMENT, AND METHOD OF MAKING A REINFORCED CONCRETE STRUCTURE WITH CAVITIES

TECHNICAL FIELD

The present invention relates to an element for use in making a reinforced concrete structure of the kind having filler bodies therein.

BACKGROUND ART

The International PCT-application No. WO 92/06253 discloses an element of the kind referred to above. In this known structure, the filler bodies used for forming cavities in the structure are in the form of closed hollow spheres, ovoids or similar rounded bodies.

With filler bodies of the shapes referred to, a lower shuttering is absolutely necessary, and—due to the rounded shape of the filler bodies—concrete will unavoidably penetrate between the filler bodies and the lower shuttering. For this reason, during grouting or casting, unhardened concrete will tend to make the filler bodies "float" upwardly, so that it is necessary to anchor the reinforcing element firmly.

DISCLOSURE OF THE INVENTION

It is the object of the present invention to provide an element of the kind referred to above, which does not suffer from the disadvantages described above, and this object is achieved with such an element, according to the present invention as described below.

With this arrangement, no concrete will penetrate below the filler bodies, so that the lower part of the final concrete structure will comprise no more concrete than that immediately surrounding the rods in the lower reinforcing mesh, and the flanges on the filler bodies also co-operate to prevent unhardened concrete from penetrating below the filler bodies and making them "float", at the same time forming a lower shuttering, so that the usual lower shuttering may be dispensed with.

DE-A-2,633,526 discloses a trough-shaped shuttering body or element of glass-fibre-reinforced concrete for making ribbed or cross-ribbed structures of steel-reinforced concrete. In FIGS. 2–2*c* and the associated text on page 7, 2nd paragraph, this documents discloses the use of a number of shuttering bodies 1 shaped like inverted troughs with edge flanges 2 extending towards each other, but leaving a gap 4 in between, said gap having to be closed by separate means, such as a wooden lath, to prevent the concrete from running out. The shuttering bodies 1 are held in their proper relative positions by a reinforced concrete grid 3,6. This document does not disclose the use of upper and lower reinforcing meshes co-operating with filler bodies in the manner set forth herein.

The present invention also relates to a filler body for use in making a reinforcing element according to the invention, and this filler body is constructed as set forth herein.

Finally, the present invention relates to a method for making a reinforced concrete structure. This method is of the kind set forth herein.

Advantageous embodiments of the element and the filler body for use in making it are set forth below.

BRIEF DESCRIPTION OF THE DRAWINGS

In the following detailed portion of the present description, the invention will be explained in more detail with reference to the drawings, in which.

DESCRIPTION OF THE PREFERRED EMBODIMENTS

Figure 1:
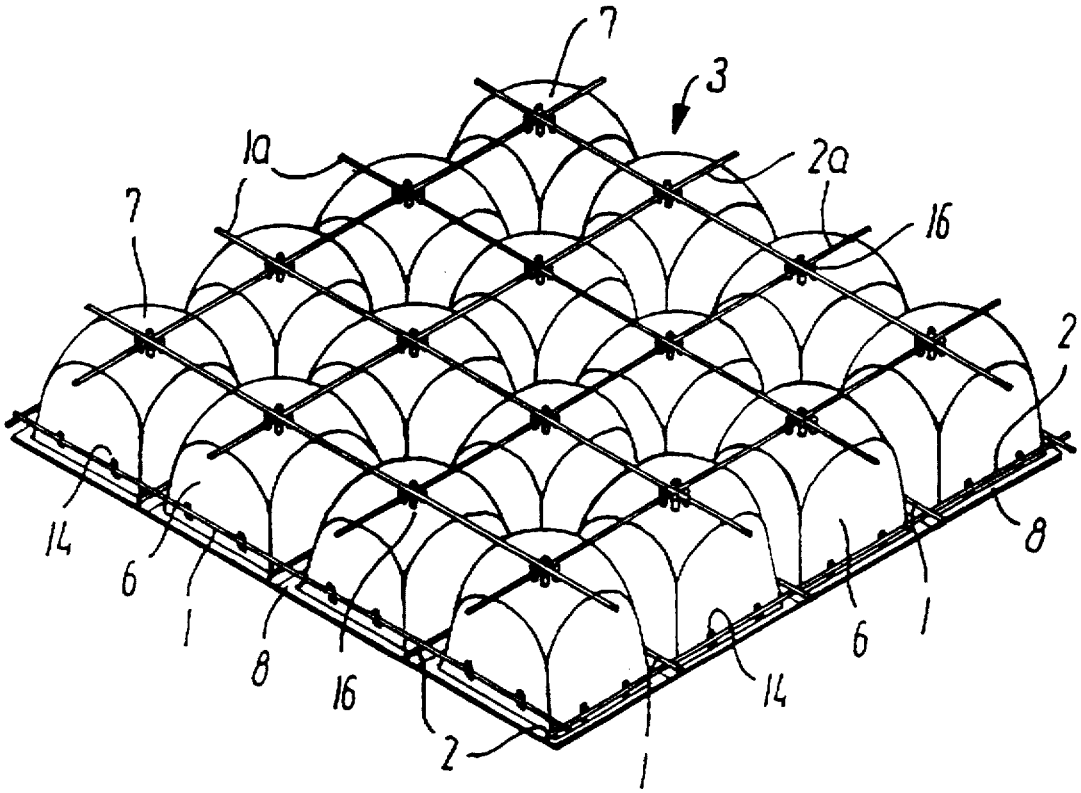
FIG. 1 is a perspective view of a part of a combined reinforcement and shuttering element according to the invention.

The part of a combined reinforcement and shuttering element shown in perspective in FIG. 1 is a rigid body consisting of a number of crosswise lower reinforcing rods 1, a number of lengthwise lower reinforcing rods 2, a number of crosswise upper reinforcing rods 1*a*, a number of lengthwise upper reinforcing rods 2*a*, and a number of hollow filler bodies 3 secured below within the squares formed by the lower reinforcing mesh constituted by the rods 1 and 2, and secured at the top to the upper mesh constituted by the rods 1*a* and 2*a*, said securing being achieved by means to be described below.

When assembling an element, part of which is shown in FIG. 1, the lower reinforcing mesh consisting of all the crosswise lower reinforcing rods 1 and the lengthwise lower reinforcing rods 2, preferably welded together so as to form a rigid structure, is placed in position on a suitable base. Then, the hollow bodies 3 are placed in the "squares" formed by the mesh, engaging the latter by means of locking ribs 14, the flanges 8 abutting sealingly against adjacent flanges, if any. The notches in the locking ribs 14 on the hollow bodies 3 for engagement with the crosswise lower reinforcing rods 1 are placed at a slightly higher level than those for the lengthwise lower reinforcing rods 2, so as to allow for the slight difference in level between the reinforcing rods caused by their finite thickness. These notches will ensure that the reinforcing mesh is placed at the correct level relative to the flanges 8, with which the finished element will rest on a suitable in-situ support prior to grouting or casting.

Figure 2:
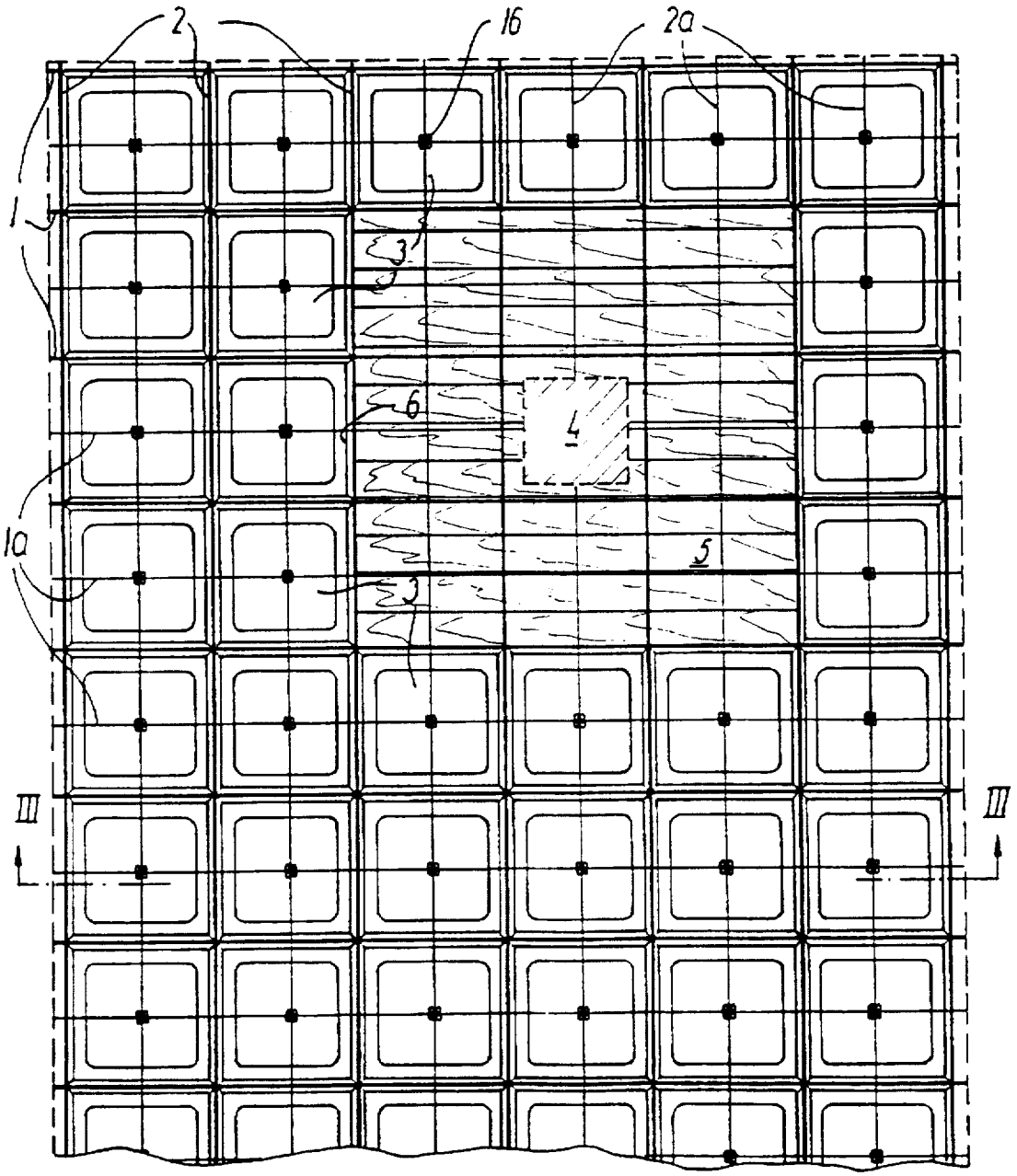
FIG. 2 is a top view of an element, in which filler bodies have been removed from some of the squares, placed in readiness for grouting or casting.
Figure 3:
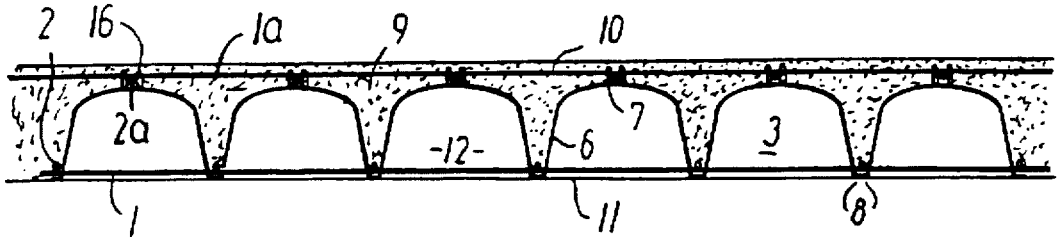
FIG. 3 is a vertical section along the line III—III in FIG. 2 and showing the finished cast concrete structure after the shuttering has been removed.
Figure 6:
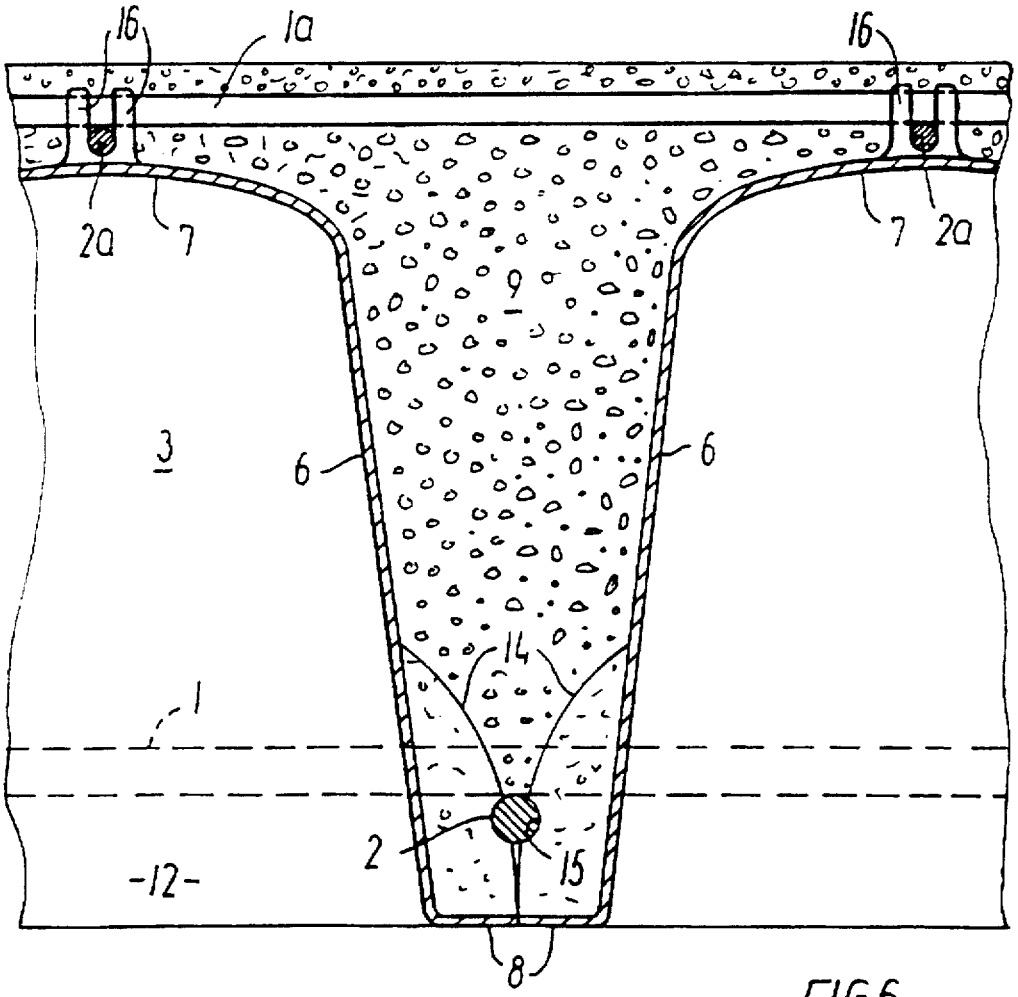
FIG. 6 at an enlarged scale shows some details of the filler bodies used in the exemplary embodiment of FIGS. 4 and 5.

The hollow bodies 3, vide also FIG. 3, are shaped roughly like inverted buckets, in the exemplary embodiment shown in FIGS. 1–3 having a side-wall section 6 of roughly frusto-pyramidal shape, continuing upwardly in a domed top section 7 and downwardly into the above-mentioned flange 8, vide also FIG. 6. In the final assembling step, an upper reinforcing mesh consisting of the crosswise upper reinforcing rods 1*a* and the lengthwise upper reinforcing rods 2*a* is placed on top of the domed top sections 7, being held by resilient clamping fingers 16 formed integrally with the top sections 7 and projecting upwardly from the latter.

An element formed in this manner is quite rigid, and will withstand stresses normally encountered in handling and transport. Further, due to the use of a lower reinforcing mesh 1,2 and an upper reinforcing mesh 1*a*,2*a*, rigidly interconnected through the hollow bodies 3, the element will be able to withstand considerable loads, such as by being filled with concrete whilst resting on supports at a substantial distance from each other.

The finished assembly consisting of the reinforcing meshes 1,2 and 1*a*,2*a* and the hollow bodies 3—and even pipes, cables etc. forming parts of the final structure, and parts of any requisite shuttering secured thereto—may be transported from the factory or workshop to the building site and placed in position, after which the process of grouting, setting of the concrete and removal of the shuttering will proceed in the usual manner.

When grouting has taken place on the assembly shown in FIG. 2, and the concrete has set, a structure as shown in vertical section in FIG. 3 will have been produced. This structure comprises—of course—the parts shown in FIGS. 1 and 2, as well as a monolithic concrete body 9 having an upper side 10 and a lower side 11. In the exemplary embodiment shown, the upper side 10 consists solely of a continuous body of concrete, reinforced by the upper reinforcing rods 1*a* and 2*a*, while the lower side 11 consists of a number of mutually crossing ribs bounding the downwardly facing open sides 12 of the hollow bodies 3, reinforced by the lower reinforcing rods 1 and 2.

As will be seen in FIG. 2, the hollow bodies 3 have been removed from the squares surrounding a square, through which a column 4 extends. The shuttering 5 thus made necessary can be seen through these "empty" squares.

Figure 5:
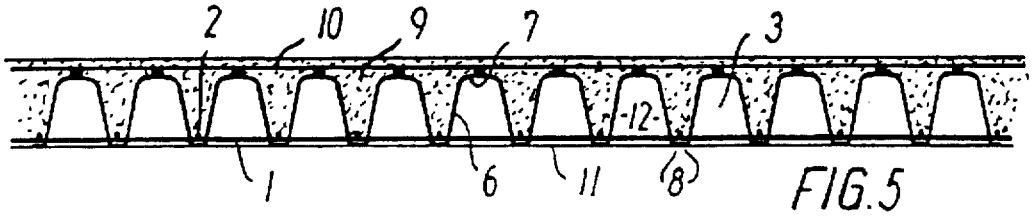
FIGS. 4 and 5 are views corresponding to FIGS. 2 and 3 respectively showing a slightly modified exemplary embodiment.
Figure 4:
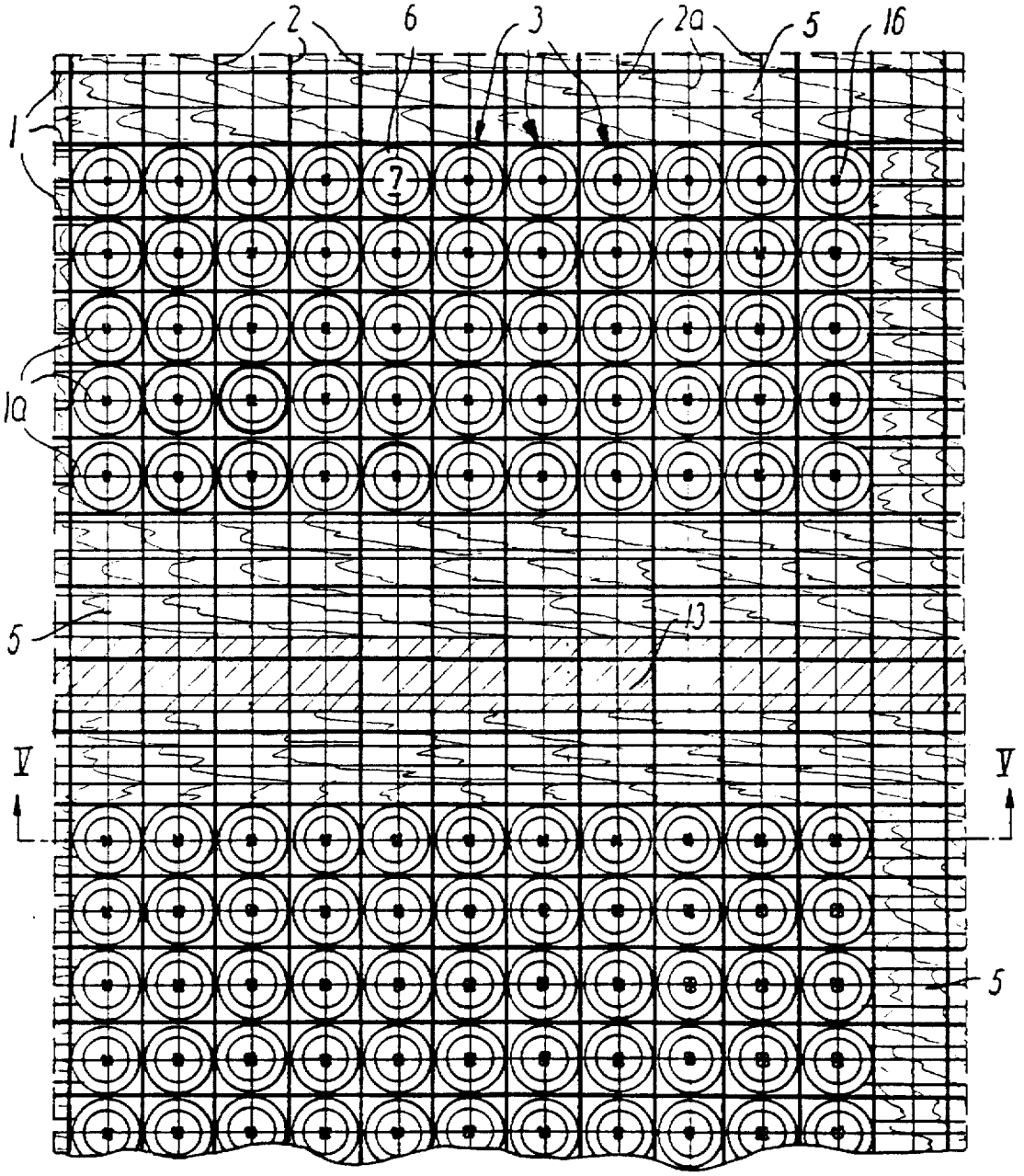

The assembly of elements and the structure shown in FIGS. 4 and 5 respectively correspond in principle to those shown in FIGS. 1–3, differing solely in that there is no column like the column 4 in FIG. 2, but instead a supporting wall 13, and that the side-wall section 6 in each of the hollow bodies 3 is frusto-conical instead of frusto-pyramidal as in FIGS. 1–3.

Obviously, the same functions apply as described above with reference to FIGS. 1–3.

FIG. 6 shows more clearly—due to the enlarged scale—the construction of the hollow bodies 3 with regard to the flange 8 surrounding the open side 12 and the locking ribs 14 referred to above. Thus, in the exemplary embodiment shown, the engagement means consist of a number of fin-like locking ribs 14 protruding from the outside of the side-wall section 6. Each locking rib 14 has a notch 15 adapted to cooperate with reinforcing rods 1 or 2, in the example shown in FIG. 6 one of the lengthwise reinforcing rods 2. As the crosswise reinforcing rods 1 will necessarily be at a level differing from the level of the lengthwise reinforcing rods 2, the notches 15 in the locking ribs 14 on the sides of the hollow bodies 3 adapted to cooperate with the crosswise reinforcing rods 1 will be placed at a different level than the level of the notch 15 shown in FIG. 6 cooperating with the lengthwise reinforcing rod 2. In order to achieve a stable interlocking of the hollow bodies 3 with the reinforcing mesh consisting of the reinforcing rods 1 and 2, at least two locking ribs 14 may be used on each side of each hollow body 3, i.e. a total of eight ribs on each hollow body. Other solutions are, however, possible.

Figure 7:
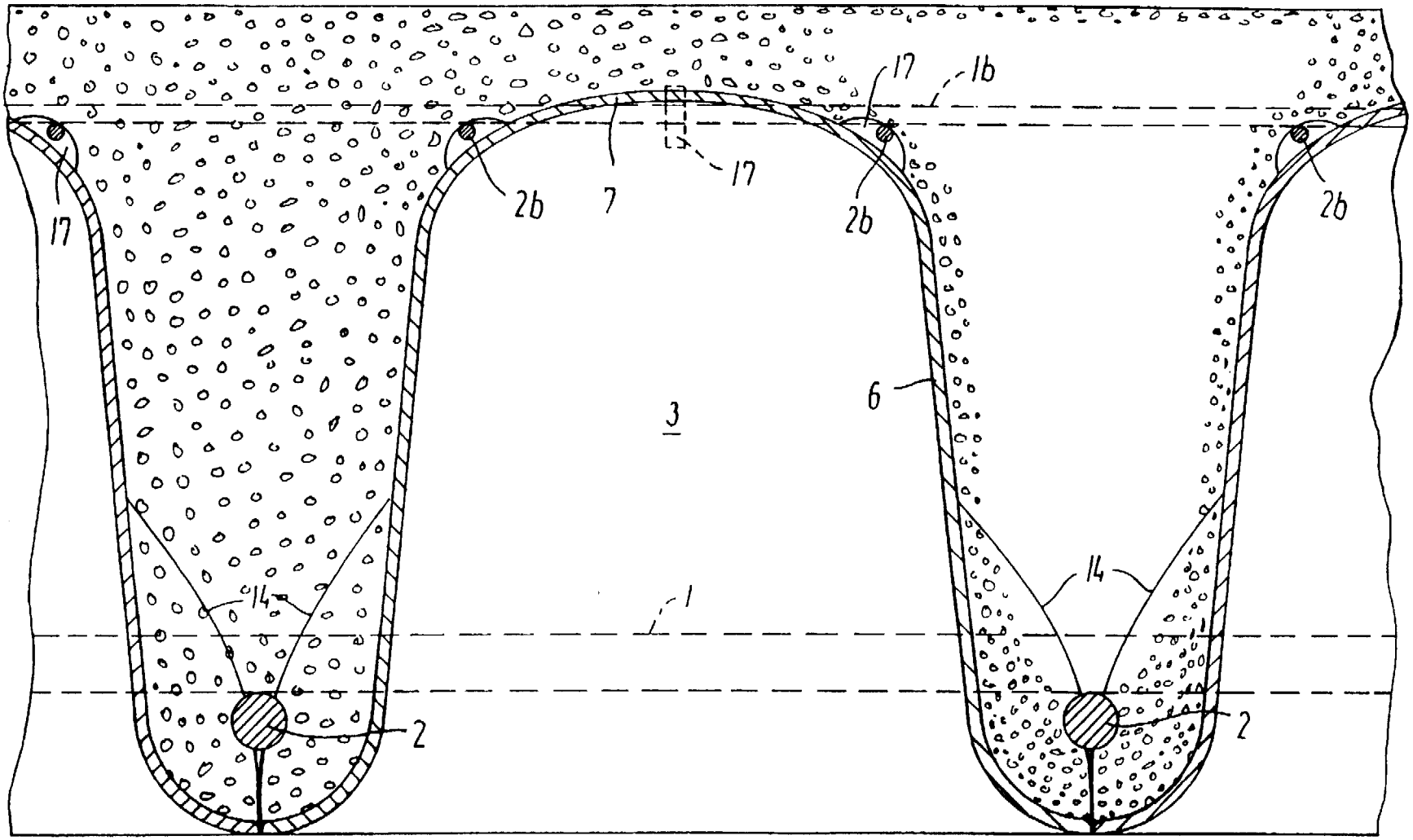
FIG. 7 is a sectional view resembling FIG. 6, but shows an exemplary embodiment having twice as many upper reinforcing rods.

In the exemplary embodiment shown in FIG. 7, the upper reinforcing mesh consists of crosswise upper reinforcing rods 1*b* and lengthwise upper reinforcing rods 2*b* with a mutual spacing one-half of the mutual spacing between the crosswise lower reinforcing rods 1 and the lengthwise lower reinforcing rods 2. The upper reinforcing mesh is secured to the hollow bodies 3 by means of integrally formed locking ears 17 in the transition region between the side-wall section 6 and the top section 7, preferably in snap-fit fashion. This arrangement gives an increased rigidity of an element like the one illustrated in FIG. 1, in addition producing a more homogeneous reinforcing effect with regard to point-wise loading of the upper surface of the finished concrete structure.

If the hollow bodies 3 are produced, as is in fact preferred, by injection moulding suitable plastic material, such as PVC or polyethylene, both the locking ribs 14 on the outside of the side-wall section 6 and the clamping fingers 16 or the locking ears 17 on the top section 7 may be moulded integrally with the rest of the hollow bodies.

As indicated above, the flanges 8 may be so shaped and dimensioned, that they are in mutual abutment or engagement, acting as local shuttering for the lower faces of the ribs containing the rods 1 and 2. If the hollow bodies are to remain as "permanent shuttering", this arrangement will also give the downwardly facing side of the structure, possibly constituting a ceiling for the space below, a more pleasing appearance, at the same time protecting the concrete structure against aggressive media.

Instead of being manufactured singly, the hollow bodies 3 may be manufactured in the form of webs with a width and length corresponding to the total width and length of an integral number of hollow bodies. In this case, the flanges 8 will be common to two adjoining bodies, and will—of course—be perfectly leak-proof with respect to the unhardened concrete. Such webs may be manufactured by any conventional method, such as by vacuum-forming plastic sheet material.

In the exemplary embodiments described above and shown in the drawings, the filler bodies 3 are described and shown as being hollow. It is, however, possible to use compact filler bodies, preferably made from foamed plastic material, or hollow bodies substantially as described and shown, but having a filling of foamed plastic material.

In the exemplary embodiments described above and shown in the drawings, all the reinforcing rods have been described and shown as each constituted by a single rod. It does, however, lie within the scope of the invention to use two, three, four or more parallel rods with mutual spacing, in place of these single rods. This especially applies to the lower reinforcing rods 1 and 2, providing tensional strength in the ribs forming the lower part of the finished structure, in which e.g. two rods may be placed on top of each other.

The present invention was occasioned by the need to combine the advantages of mass or series production related to prefabricated concrete elements, with the adaptability and possibility of crosswise reinforcing achieved with in-situ casting, while at the same time reducing the transport costs relating to the heavy part of the building material, i.e. the concrete itself.

As will be evident from the above description, the use of elements according to the invention, comprising the simultaneous provision of shuttering, reinforcement and weight-reducing recesses, will be most useful with in-situ casting of concrete decks where there is a need of reducing the weight.

Thus, the invention teaches a technology, that is simple with regard to the manufacturing aspect, for reducing the weight of the conventional crosswise-reinforced concrete slabs, by integrating recess-forming boxes or cupolas in the lower side of the concrete deck.

When prefabricating elements according to the invention in a factory, the size of the elements will generally be determined by the available transport facilities, e.g. with a width of approx. 2.5 m and a length of 10–14 m. Thus, the size of the element is not closely related to the in-situ support or span conditions, as the finished deck will function as a continuous load-supporting deck.

The only work remaining to be done on the building site is essentially the placing of the elements in position, and then the grouting or casting, preferably by using a concrete pump.

I claim:

1. A reinforcing element for use in making a reinforced concrete structure of substantially planar shape comprising:

a lower reinforcing mesh including mutually crossing reinforcing rods rigidly secure to each other;

an upper reinforcing mesh including mutually crossing reinforcing rods rigidly secured to each other;

a plurality of discrete spaced filler bodies of substantially identical shape and size cooperating with said upper and lower meshes so as to locate said filler bodies in a regular pattern corresponding to a pattern of said upper and lower meshes, said filler bodies interengaging with said upper and lower meshes so as to form a rigid body, and each said filler body having:

a major face for facing in a same direction as a lower side of the concrete structure, edges around said major face, and a flange extending outwardly from each said edge so as to cooperate with an adjacent said flange of an adjacent said filler body such that a lower shuttering is formed by adjacent said flanges.

2. A reinforcing element as claimed in claim 1:

wherein at least one of said hollow bodies is hollow and said major face is open.

3. A reinforcing element as claimed in claim 1:

wherein each said filler body further includes an engagement means for holding said filler body in engagement with said lower reinforcing mesh.

4. A reinforcing element as claimed in claim 1:

wherein each said filler body further includes an engagement means for holding said filler body in rigid engagement with said upper reinforcing mesh.

5. A reinforcing element as claimed in claim 1 wherein each said filler body further includes:

a respective side-wall section extending upwardly and convergently from a periphery of said major face, and a top section to which said side-wall section converges such that said side-wall section and top section form an upper shuttering between the lower shuttering formed by said flanges.

6. A reinforcing element as claimed in claim 5:

wherein said top section is domed shaped with a smooth transition to said side-wall section.

7. A reinforcing element as claimed in claim 5:

wherein said side-wall section is substantially rectangular in a cross section parallel to said lower mesh.

8. A reinforcing element as claimed in claim 5:

wherein said side-wall section is one of substantially circular or elliptical in a cross section parallel to said lower mesh.

9. A reinforcing element as claimed in claim 1:

wherein at least one of said filler bodies is solid.

10. A reinforcing element as claimed in claim 9:

wherein said at least one of said filler bodies which is solid is filled with a foamed plastic material.

11. A reinforcing element as claimed in claim 1:

wherein at least one of said filler bodies includes a shell of dense material and a filling of less dense material.

12. A reinforcing element as claimed in claim 11:

wherein said filling is a foamed plastic material.

13. A reinforcing element as claimed in claim 2:

wherein each said filler body further includes a first engagement means for holding said filler body in engagement with said lower reinforcing mesh.

14. A reinforcing element as claimed in claim 13:

wherein each said filler body further includes a second engagement means for holding said filler body in rigid engagement with said upper reinforcing mesh.

15. A reinforcing element as claimed in claim 14 wherein each said filler body further includes:

a side-wall section extending upwardly and convergently from a periphery of said major face, and a top section to which said side-wall section converges such that said side-wall section and top section form an upper shuttering between the lower shuttering formed by said flanges.

16. A reinforcing element as claimed in claim 15:

wherein said top section is domed shaped with a smooth transition to said side-wall section.

17. A method of making a reinforced concrete structure comprising the steps of:

forming a reinforcing element, said reinforcing element having (a) a lower reinforcing mesh including mutually crossing reinforcing rods rigidly secure to each other, (b) an upper reinforcing mesh including mutually crossing reinforcing rods rigidly secured to each other, and (c) a plurality of discrete spaced filler bodies of substantially identical shape and size, each said filler body having (i) a major face facing in a same direction as a lower side of the concrete structure, (ii) edges around said major face, and (iii) a flange extending outwardly from each said edge, said forming step including the steps of (a) cooperating said filler bodies with said upper and lower meshes so as to locate said filler bodies in a regular pattern corresponding to a pattern of said upper and lower meshes and so as to cooperate each flange with an adjacent said flange of an adjacent said filler body such that a lower shuttering is formed by adjacent said flanges, and (b) interengaging said filler bodies with said upper and lower meshes so as to form a rigid body;

placing at least one reinforcing element in a casting space;

casting a fluid concrete in said space and allowing said fluid concrete to set.

18. A method of making a reinforced concrete structure as claimed in claim 17:

wherein said interengaging step includes engaging said lower reinforcing mesh with an engagement mechanism integrally provided on each said filler body.

19. A method of making a reinforced concrete structure as claimed in claim 17:

wherein said interengaging step includes rigidly engaging said upper reinforcing mesh with an engagement mechanism integrally provided on each said filler body.

20. A method of making a reinforced concrete structure as claimed in claim 17:

wherein each said filler body further includes (a) a respective side-wall section extending upwardly and convergently from a periphery of said major face, and (b) a top section to which said side-wall section converges; and wherein said interengaging step forms an upper shuttering formed by said side-wall section and top section between the lower shuttering formed by said flanges.

21. A method of making a reinforced concrete structure as claimed in claim 17:

wherein said forming step includes the filling of at least one of said filler bodies with a foamed plastic material.

22. A method of making a reinforced concrete structure as claimed in claim 18:

wherein said interengaging step includes rigidly engaging said upper reinforcing mesh with an engagement mechanism integrally provided on each said filler body.

23. A method of making a reinforced concrete structure as claimed in claim 22:

wherein each said filler body further includes (a) a respective side-wall section extending upwardly and convergently from a periphery of said major face, and (b) a top section to which said side-wall section converges; and wherein said interengaging step forms an upper shuttering formed by said side-wall section and top section between the lower shuttering formed by said flanges.

24. A method of making a reinforced concrete structure as claimed in claim 23:

wherein said forming step includes the filling of at least one of said filler bodies with a foamed plastic material.

* * * * *